United States Patent [19]

Gow

[11] 4,011,911

[45] Mar. 15, 1977

[54] PORTABLE FIRE EXTINGUISHER

[76] Inventor: Quinn W. Gow, 251 E. 157th St., Gardena, Calif. 90248

[22] Filed: July 11, 1975

[21] Appl. No.: 595,059

Related U.S. Application Data

[63] Continuation-in-part of Ser. No. 455,978, March 29, 1974, abandoned, which is a continuation-in-part of Ser. No. 257,201, May 26, 1972, abandoned, which is a continuation-in-part of Ser. No. 217,793, Jan. 14, 1972, abandoned.

[52] U.S. Cl. ..... 169/29; 169/42

[51] Int. Cl.[2] ..... A62C 37/30

[58] Field of Search ..... 169/26–29, 169/51, 42, 74, 89, 19, 58; 239/251, 261, 262

[56] References Cited

UNITED STATES PATENTS

| | | | |
|---|---|---|---|
| 347,216 | 8/1886 | Westcott et al. | 169/27 |
| 1,241,209 | 9/1917 | Grinnell | 169/20 UX |
| 1,849,644 | 3/1932 | Stokes | 169/26 |
| 3,613,793 | 10/1971 | Huthsing, Jr. | 169/26 |
| 3,754,602 | 8/1973 | Magdars | 169/26 X |

*Primary Examiner*—John J. Love

*Attorney, Agent, or Firm*—Berman, Aisenberg & Platt

[57] ABSTRACT

A compact portable fire extinguisher is described which distributes through the action of centrifugal force, a fire extinguishing liquid or chemical over a well defined area. In one embodiment of the invention a spring wound bell-shaped dispensing housing is constrained against rotational movement by a band secured to the housing and a non-rotatable bottom plate. The band, which is locked in position by a fusible element, also serves to seal the liquid or chemical dispensing apertures which are peripherally disposed about the bottom portion of the bell-shaped housing. When the fusible element parts in the presence of an abnormally high temperature condition, signaling the presence of an incendiary situation, the band falls away from the bottom plate and the housing simultaneously permitting the spring wound housing to commence rotating and the liquid or chemical extinguisher to be discharged through the peripherally disposed apertures. The rotating bell-shaped housing, through its generated centrifugal force, will expel the extinguishing liquid or chemical in a well defined circular pattern over the burning area.

In other embodiments of the invention the rotating force is supplied through the release of the fire extinguishing substance through jet-like nozzles, so that the reaction force will cause the unit containing the fire extinguishing substance to rotate, or cause the nozzles themselves to rotate, thus dispersing the liquid or chemical extinguisher. Apparatus is also provided for automatically lowering the fire extinguisher from a ceiling or the like when a fire breaks out and retracting it after it has served its function.

9 Claims, 44 Drawing Figures

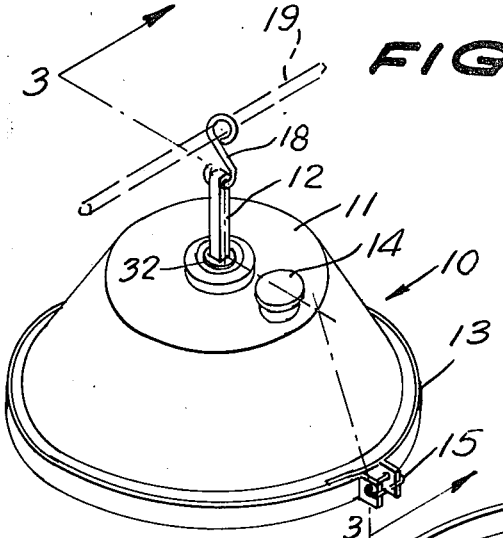
FIG. 1.
19
3
18
12
11
14
32
10
13
15
3
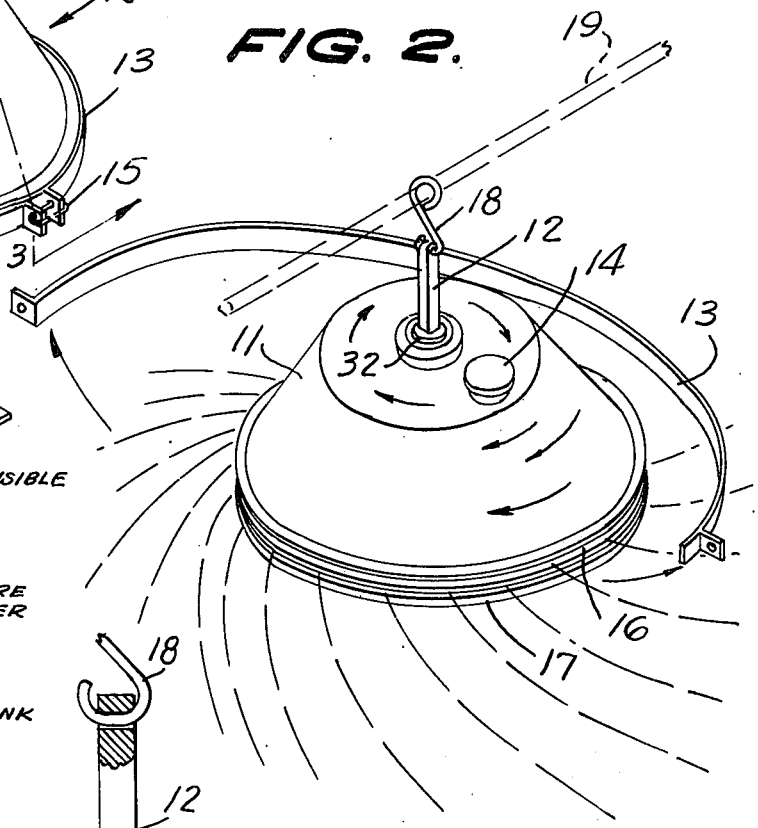
FIG. 2.
19
18
12
14
13
11
32
16
17
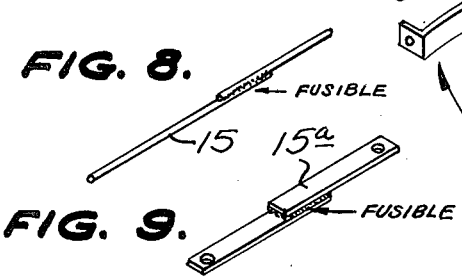
FIG. 8.
FUSIBLE
15
15a
FIG. 9.
FUSIBLE
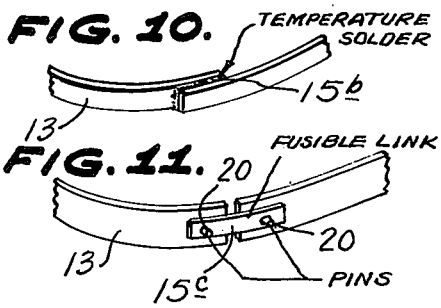
FIG. 10.
TEMPERATURE SOLDER
15b
13
FIG. 11.
FUSIBLE LINK
20
20
13
15c
PINS
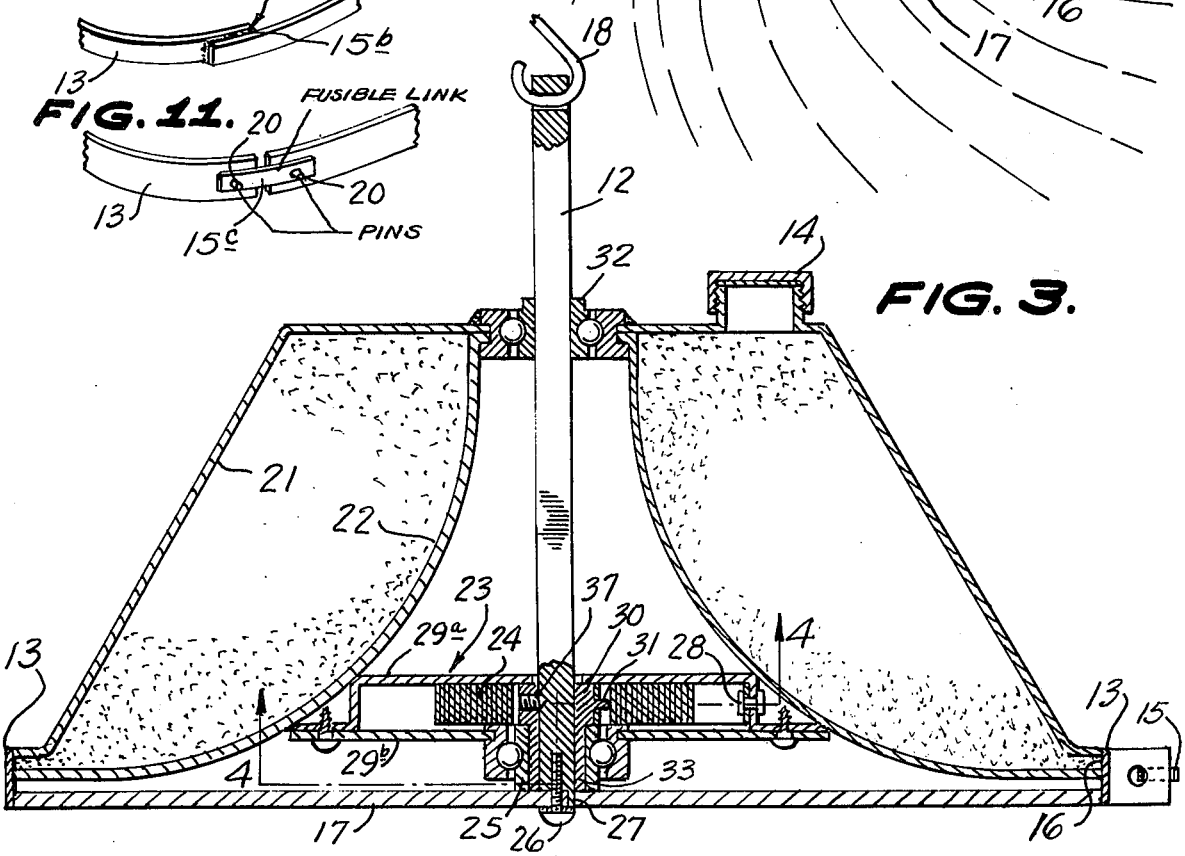
FIG. 3.
18
12
32
14
21
22
23
37
30
29a
24
31
28
4
13
13
15
29b
33
4
17
25
26
27
16

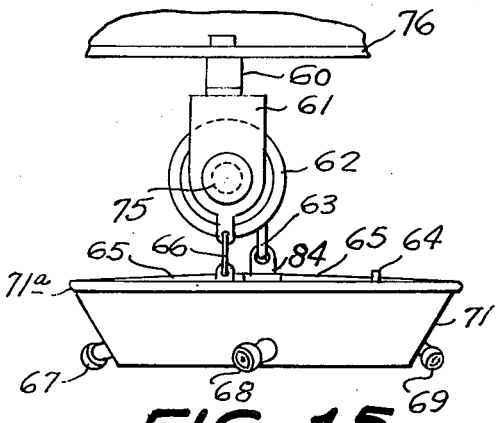
FIG. 15.
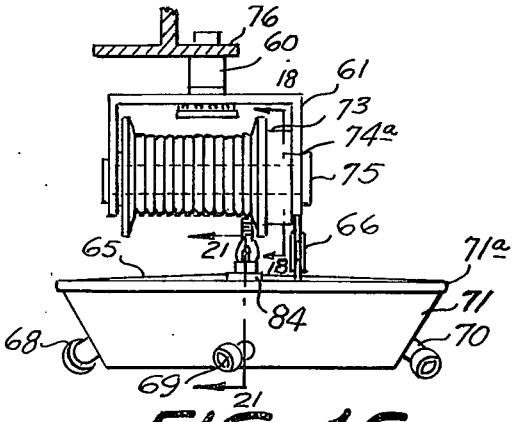
FIG. 16.
FIG. 17.
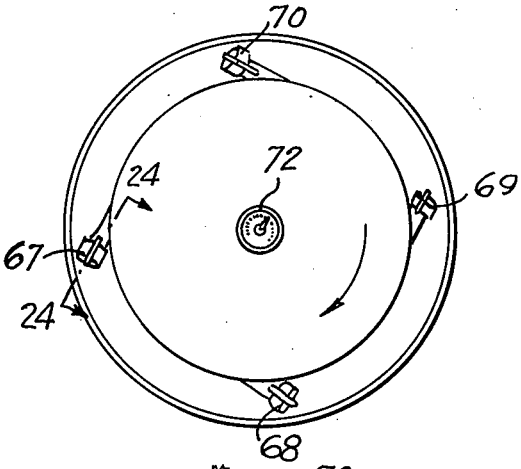
FIG. 18.
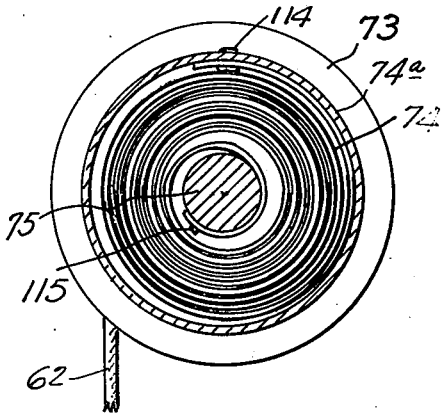
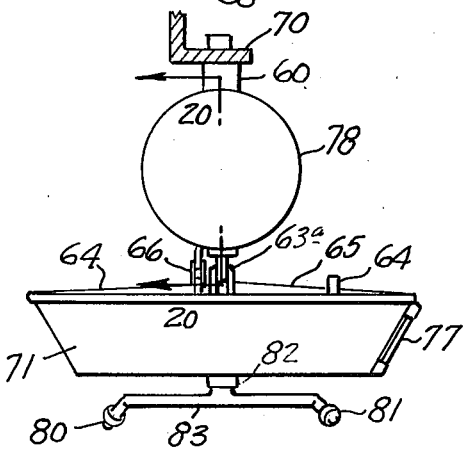
FIG. 19.
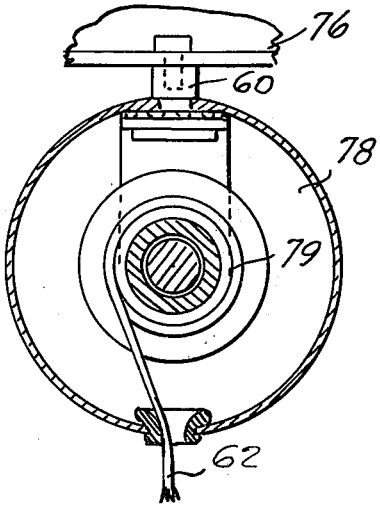
FIG. 20.

FIG. 28.
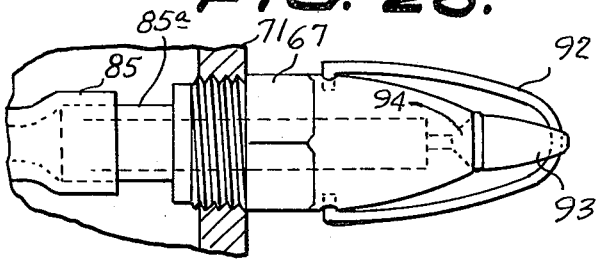
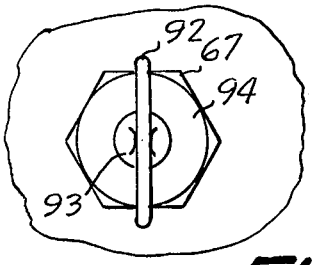
FIG. 29.
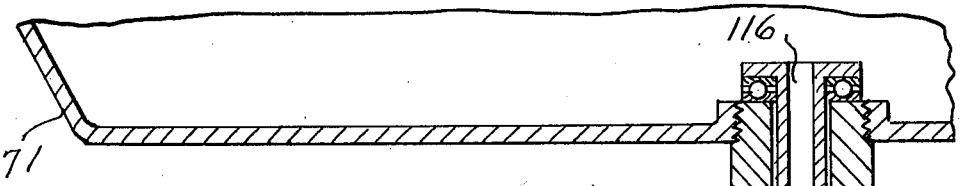
FIG. 30.
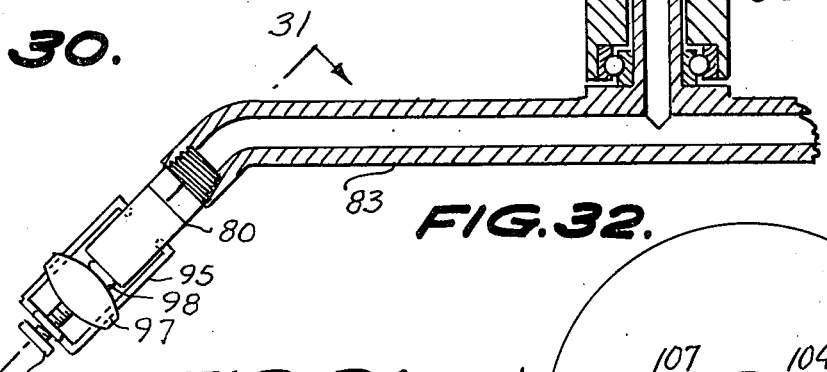
FIG. 32.
FIG. 31.
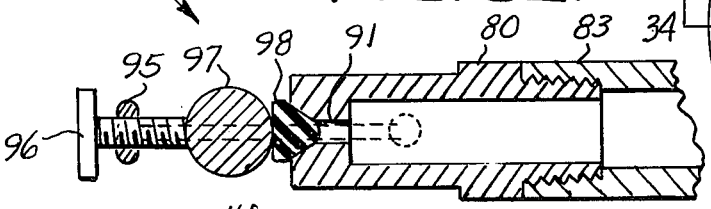
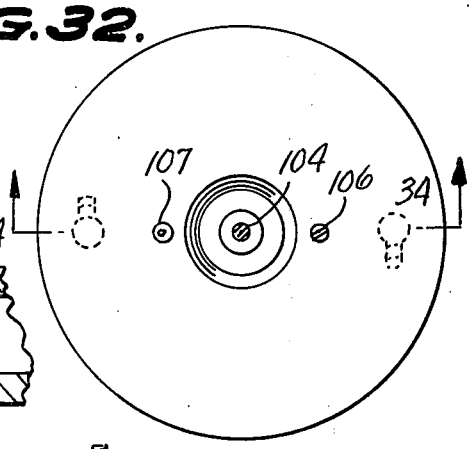
FIG. 33.
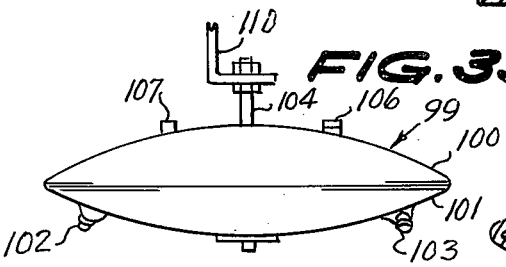
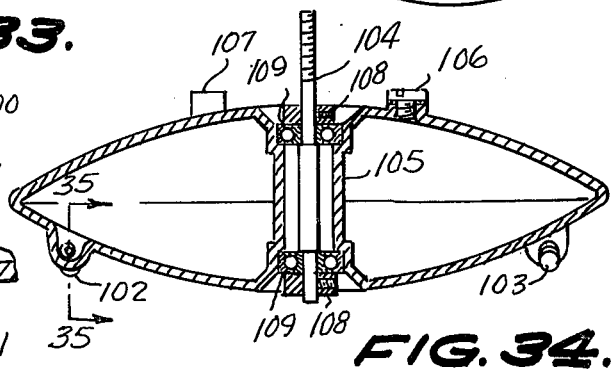
FIG. 34.
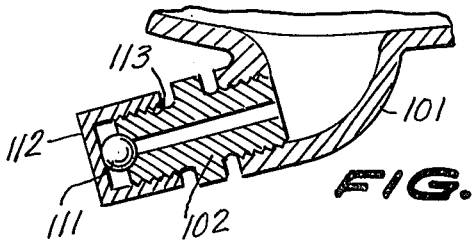
FIG. 35.

FIG. 38.
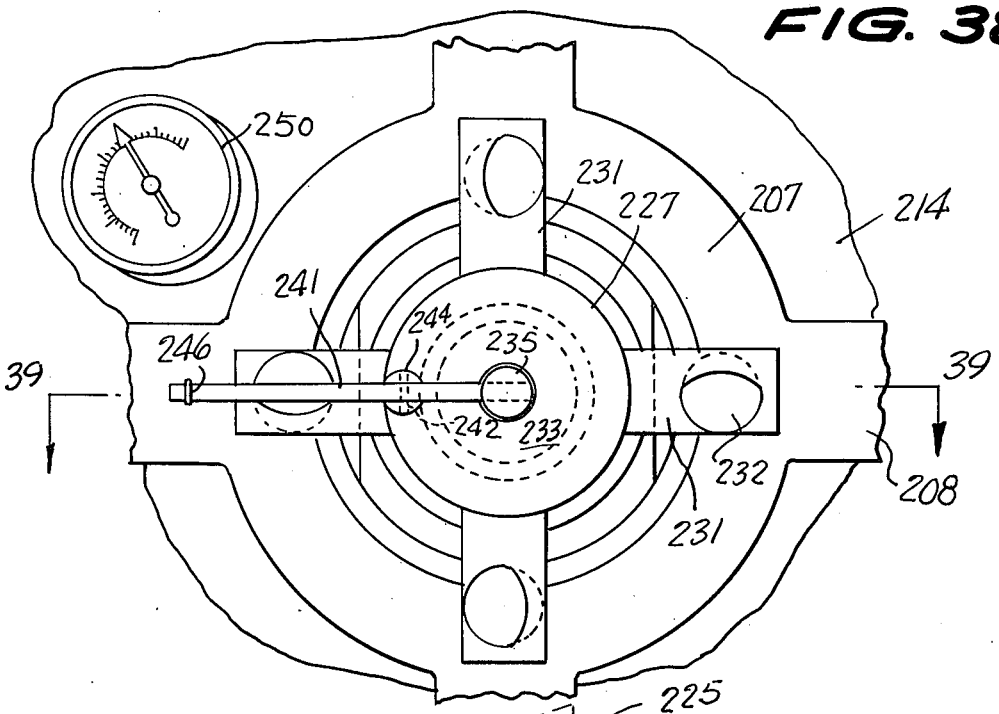
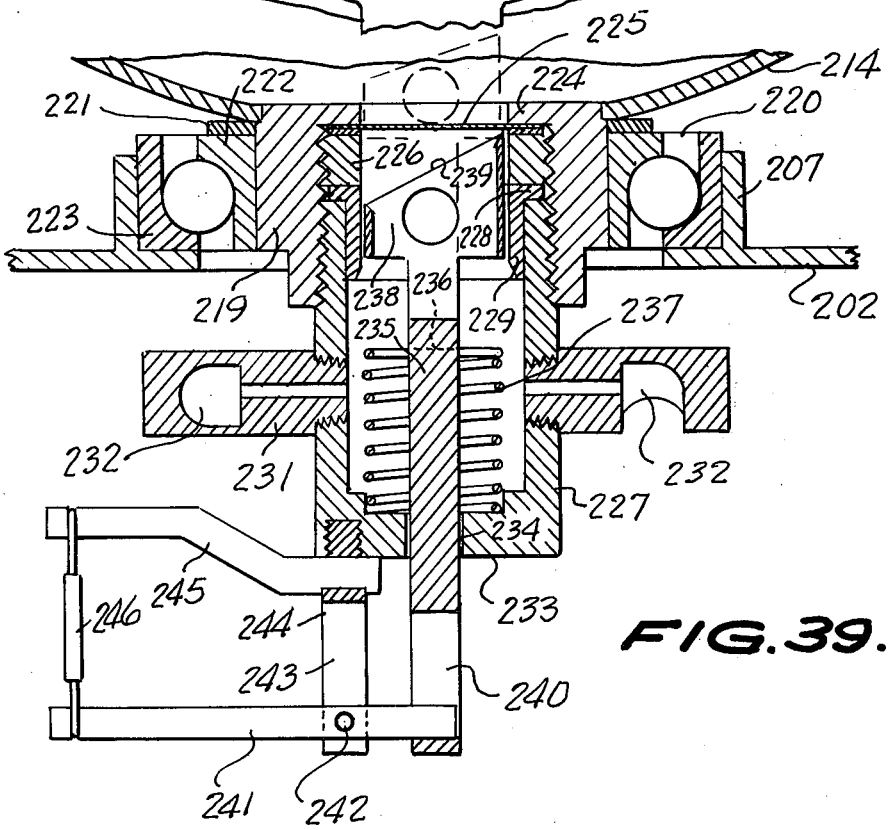
FIG. 39.

PORTABLE FIRE EXTINGUISHER

This application is a continuation-in-part of my copending application, Ser. No. 455,978, filed Mar. 29, 1974 now abandoned, which was, in turn, a continuation-in-part of my previously filed application, Ser. No. 257,201, filed May 26, 1972 now abandoned, which was, in turn, a continuation-in-part of my previously filed application Ser. No. 217,793, filed Jan. 14, 1972 now abandoned.

This invention relates to automatic fire extinguishers, and more particularly relates to an improved self-contained automatic fire extinguisher which requires no external power source for its operation.

In the past, it has been found that automatic fire extinguishers, such as the conventional sprinkler system, suffered from a wide variety of infirmities which made them impractical to use. For example, systems which require a source of water might well fail during earthquakes or in the presence of other conditions which might cause the water pipes to burst. By the same token, if water pressure were down, during a water shortage, for example the fire extinguishing system might well fail at the precise moment it was needed.

Moreover, the prior art water operated automatic fire extinguisher was not readily adaptable to situations where protection against fire might be desired, but no source of water power was available. Such environments where automatic fire extinguishers would be desirable, but to date have been unavailable, are, for example, forests, street cars, automobile and truck engines, on board ship and in similar applications.

A further disadvantage which the prior art automatic fire extinguisher suffered from was its difficulty of installation and relative high cost. There is no known automatic fire extinguisher, available to the home owner, for example, which is simple in construction, low in cost and readily installable with a minimum of effort.

Accordingly, it is an object of the present invention to provide a new and improved automatic portable fire extinguisher which eliminates the above-described disadvantages of the prior art fire extinguisher.

Another and more specific object of the present invention is to provide an automatic fire extinguisher which requires no outside source of power for its operation.

Still another object of the present invention is to provide an automatic portable fire extinguisher which will not fail when the water supply is abnormally low or inoperative.

A still further object of the present invention is to provide an automatic portable fire extinguisher which may be conveniently and readily installed in a variety of remote locations.

A further object of the present invention is to provide a new and improved automatic portable fire extinguisher which is readily adaptable to dispensing a dry chemical fire extinguishing medium.

A still further object of the present invention is to provide a portable automatic fire extinguisher which is rotatably actuated by the release of a sealing element in the presence of an incendiary condition.

Another object of the present invention is to provide a portable automatic fire extinguisher which is actuated by a piercing element puncturing the vessel containing the fire extinguishing composition in response to the parting of a fusible element in the presence of an incendiary condition, the detection of an incendiary condition by a detecting element or by the manual closure of a switching element.

Yet another object of the present invention is to provide a fire extinguisher which is automatically lowered toward the vicinity of the fire in the presence of an incendiary condition and is automatically retracted after the extinguisher has served its function.

These and other objects of the invention are realized in the specific embodiments described hereinafter. Briefly, in one group of embodiments the present invention comprises a bell-shaped housing having compartments therein for storing a liquid or dry chemical fire extinguishing composition. The bell-shaped housing may be spring wound about a centrally disposed stationary shaft which is fixedly secured to the bottom plate of the housing. An annular opening is provided at the bottom of the storage compartments in the housing for dispensing the fire extinguishing composition. This annular opening is sealed by a band which also fixedly secures the rotatable housing to the bottom plate. The band is held in place by a fusible element which parts in the presence of unusually high temperature conditions signaling the presence of fire. The band will then fall away from the housing, simultaneously permitting the housing to rotate about the shaft and unsealing the annular opening at the bottom of the storage compartment. The rotation of the bell-shaped housing will cause the fire extinguishing composition to be expelled through the annular opening in a well defined circular pattern under the influence of the generated centrifugal force.

In a second group of embodiments the fire-extinguishing composition is contained within a housing under pressure. A plurality of jet-like nozzles are in communication with the interior of the housing and are sealed by fusible elements. When the ambient temperature exceeds a predetermined value indicating the presence of a fire, the fusible elements melt and the fire extinguishing composition is expelled under pressure through the nozzle orifices. This causes reaction forces to be exerted, either on a rotatably mounted housing or on a rotatably mounted nozzle assembly, causing rotation of the nozzles and dispersion of the fire-extinguising composition over the burning area.

In a third group of embodiments the fire extinguishing composition is contained within a housing under pressure. A plurality of jet-like nozzles are in communication with the interior of the housing, but are sealed off therefrom by a frangible sealing member. Piercing means for rupturing the frangible member is activated by the detection of a incendiary condition, by the parting of a restraining fusible element or by the manual closure of a switch.

Adapted for use with any of the groups of embodiments is apparatus for automatically lowering and retracting the extinguisher when it is installed for use in an environment such as a high-ceilinged factory building. This apparatus comprises a spring-biased spool or the like around which is wound a cord, or the like, one end of which is fastened to the extinguisher and the other end to the spool. The extinguisher is normally held in the retracted position against the ceiling, for example, by a fusible link, with the cord wound around the spool. The fusible link is of a material having a slightly lower melting temperature than the fusible elements sealing the extinguisher. Thus, at the inception of an incendiary condition, the fusible link parts, and the extinguisher is lowered to the vicinity of the fire, under the influence of its own weight. After the extinguisher has fulfilled its function and the extinguishing composition has been dispersed, the extinguisher, now lighter in weight, will be hoisted to the retracted position by the action of the spring-biasing means on the spool and cord.

A fuller understanding of the present invention will be obtained by a consideration of the detailed description set forth hereinbelow when taken with the accompanying drawings, wherein:

FIG. 1 is a perspective view of the fire extinguisher of the present invention mounted in place and fully assembled;

FIG. 2 is a perspective view similar to that in FIG. 1, but showing the fire extinguisher of the present invention in operation;

FIG. 3 is a cross-sectional view taken on line 3—3 in FIG. 1;

FIG. 8 is a perspective view of the fusible link shown in FIG. 1;

FIG. 9 is a perspective view of an alternative embodiment of the fusible link.

FIG. 10 is a perspective view of another embodiment of the fusible link;

FIG. 11 is a perspective view of still another embodiment of the fusible link;

FIG. 15 is a front elevational view showing an alternative embodiment of this invention mounted with automatic lowering and retracting apparatus;

FIG. 16 is a side elevational view of the apparatus shown in FIG. 15;

FIG. 17 is a bottom plan view of the apparatus shown in FIG. 15;

FIG. 18 is an enlarged sectional view taken on the line 18—18 in FIG. 16, looking in the direction of the arrows;

FIG. 19 is a front elevation of a variation in the embodiment shown in FIG. 16, also illustrating the use of a different automatic lowering and retracting apparatus;

FIG. 20 is an enlarged cross-sectional view taken on the line 20—20 in FIG. 19, looking in the direction of the arrows;

FIG. 28 is a detail of an alternative means for sealing the nozzle;

FIG. 29 is an end view of the sealing means shown in FIG. 28, looking from the right;

FIG. 30 is an enlarged cross-sectional view taken on the line 30—30 in FIG. 23, showing the details of the rotatable nozzle mounting and sealing means;

FIG. 31 is a sectional view taken on the line 31—31 in FIG. 30, looking in the direction of the arrows;

FIG. 32 is a top plan view of an alternative structure for the fire extinguisher shown in FIG. 15;

FIG. 33 is a front elevation of the fire extinguisher shown in FIG. 32;

FIG. 34 is a sectional view taken on the line 34—34 in FIG. 32, looking in the direction of the arrows;

FIG. 35 is a partial sectional view taken on line 35—35 in FIG. 34, showing the detail of the fusible element and sealing means for the nozzle.

FIG. 38 is an enlarged fragmentary bottom plan view taken substantially on the line 38—38 of FIG. 37; and FIG. 39 is a vertical cross-sectional view taken substantially on the line 39—39 of FIG. 38.

Figure 4:
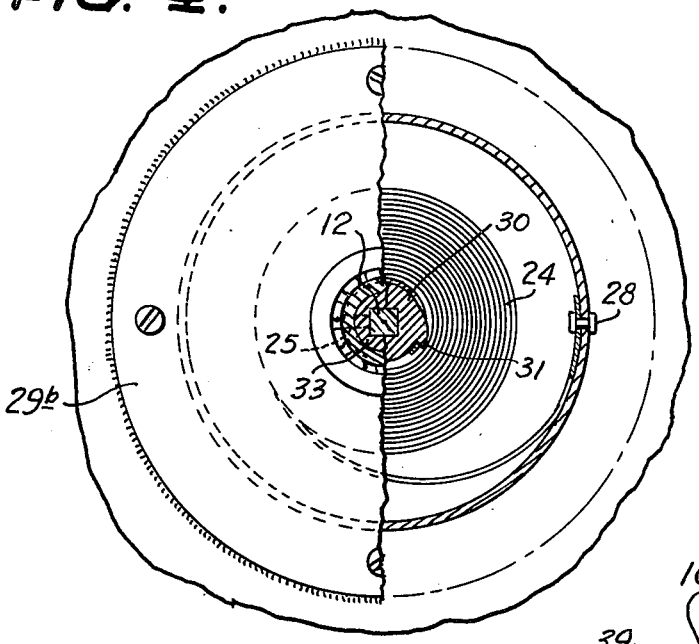
FIG. 4 is a cross-sectional view take on line 4—4 in FIG. 3.
Figure 6:
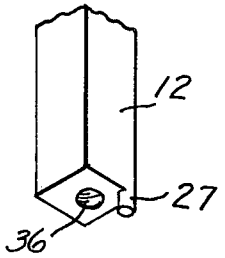
FIG. 6 is a broken away detail of the centrally disposed mounting shaft.

Referring now to FIG. 1, there is shown a first embodiment of the fire extinguisher of the present invention. Fire extinguisher 10 comprises bell-shaped housing 11 having a cap-covered filling hole 14 in the upper surface thereof. Mounting shaft 12 extends through upper ball bearing mounted fitting 32 and is suspended by mounting hook 18 from support 19, shown in dotted lines. Band 13 is tightly drawn about the bottom periphery of housing 11 and is fastened by fusible link 15 to bottom plate 17 and in sealing relationship with annular opening 16. Before band 13 is fastened by fusible link 15, the bell-shaped housing 11 is tightly wound by spring means (which will be described in detail below) about mounting shaft 12 to which bottom plate 17 is fixedly secured. Thus, when band 13 is locked in place by means of fusible link 15, it will hold tightly wound bell-shaped housing 11 against rotation about mounting shaft 12, as well as sealing annular opening 16. After band 13 is locked in place, the screw cap of filling hole 14 is opened and the storage chamber in the interior of bell-shaped housing 11 is filled with an appropriate liquid or dry chemical fire extinguishing composition. The assembly, which is now primed and ready for operation is then hung from a convenient support such as that shown schematically as 19 in FIG. 1.

FIG. 2 illustrates the fire extinguisher of FIG. 1, in operation just after a fire has been sensed. As can be seen, fusible link 15 has fallen away from band 13 due to the heat generated by the fire and band 13 has sprung away from the lower portion of bell-shaped housing 11 and bottom plate 17. Thus, bell-shaped housing 11 commences rotating about mounting shaft 12 in the direction of the arrows in FIG. 2, causing the stored liquid or chemical fire extinguishing composition to be expelled through annular opening 16 under the influence of the generated centrifugal force. The pattern in which the expelled fire extinguishing chemical falls will be circular, and its area will be controlled by the extent to which housing 11 is wound about mounting shaft 12. Typical dry chemical fire extinguishing compositions, which may be used with the fire extinguisher of this invention, are borax and baking soda. Of course, conventional liquid extinguishers, such as water, can be used also.

Referring now to FIGS. 8, 9, 10 and 11, there are shown four possible forms which the fusible link may take. As shown in FIG. 8, fusible link 15, as utilized in the embodiment of FIG. 1, simply comprises two wires soldered together. The particular solder chosen is designed to melt at a preselected temperature which, for most applications, will be approximately 140° to 212° F. The soldered link is then inserted through holes provided in band 13 and bent into place, as shown in FIG. 1.

As shown in FIG. 9, an alternative embodiment of the fusible link, 15*a*, is shown. In this case, the fusible link comprises two straps which are soldered together. The link may then be placed over pins 20 provided in strap 13, as shown in FIG. 11, or otherwise secured to strap 13 by conventional means.

FIG. 10 shows a further form where band 13 itself is soldered at 15*b* by a solder selected to melt at an appropriate temperature, as described above.

In the embodiment shown in FIG. 11, the fusible link 15*c* itself is made of solder or some other fusible material so that when an appropriate temperature is reached, it will fall away from mounting pins 20 in band 13, initiating the operation of the fire extinguisher, as described above.

Referring now to FIGS. 3, 4, 5 and 6, there is shown in detail the construction and working parts of the fire extinguisher of FIG. 1. Disposed within bell-shaped housing 11 is annular storage chamber 21 in communication with capped filling hole 14. As shown in FIG. 3, inner sloping walls 22 of bell-shaped housing 11 provide the proper configuration to aid in causing the fire extinguishing composition to flow through annular opening 16. It should be realized, however, that the inner walls 22 could take any suitable shape, although the concave shape illustrated is preferred. Further, the degree of curvature of the inner wall can be chosen so as to cause the egress of chemical or liquid to be either relatively rapid or relatively slow.

Mounting shaft 12 extends through upper ball bearing 32 which is fixedly secured to the top of bell-shaped housing 11. The lower end of mounting shaft 12 is secured in fixed position to bottom plate 17 by screw 26 which extends through hole 35 in bottom plate 17 into an appropriately threaded corresponding hole 36 in mounting shaft 12. Projection 27 at the bottom end of mounting shaft 12 is inserted in hole 34 in bottom plate 17, so as to prevent mounting shaft 12 from rotating. The bottom end of mounting shaft 12 also extends through sleeve 33 which is inserted in lower ball bearing 25. Lower ball bearing 25 is fastened, as by welding, to the lower surface of bottom wall 29*b* of spring cage 23.

Disposed within spring cage 23 between top wall 29*a* and bottom wall 29*b* is spring 24, which at one end is rigidly fastened to the spring cage 23, as by rivet 28. The other end of the spring 24 is engaged by detent 31 carried by spring engaging fitting 30 which is rigidly secured to mounting shaft 12, as by set screw 37. Spring cage 23 may be welded, or otherwise fixed to inner walls 22 of bell-shaped housing 11.

Figure 5:
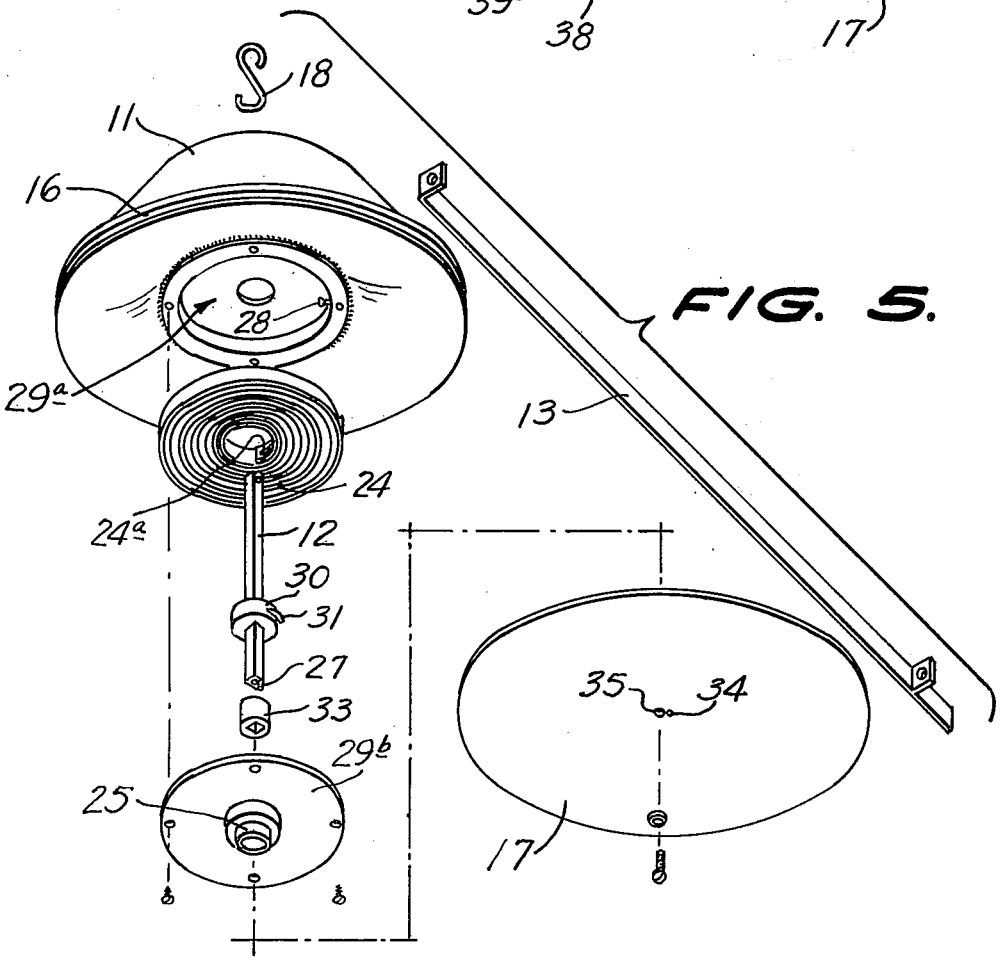
FIG. 5 is an exploded perspective view of the major components of the fire extinguisher of the present invention.

It can thus be seen, that bell-shaped housing 11 is free to rotate about mounting shaft 12 and when it is so rotated, spring 24 will gradually increase in tension until the winding has reached the desired point. Then, when band 13 is rigidly attached, as shown for example in FIGS. 1 and 3, bell-shaped housing 11 will be fixed against further rotation to bottom plate 17 and the tension in spring 24 will be stored as potential energy. When band 13 falls away, as described above in connection with FIGS. 1 and 2, the stored potential energy will cause spring 24 to unwind and rotate bell-shaped housing 11 in the opposite direction from which it was originally wound. As described above, the generated centrifugal force will cause the dry chemical or liquid stored in storage chamber 21 to be expelled through annular opening 16. It should be noted that the shape of the detent 31, as shown most clearly in FIG. 5, provides an override feature. That is, when spring 24 has fully unwound, the fire extinguisher will not stop its rotation abruptly but will rather continue since aperture 24*a* in the inner end of spring 24 will become disengaged from detent 31 and the spring will then be permitted to ride over the curved back portion of detent 31. This will permit the fire extinguisher to continue rotating until all the stored potential energy in spring 24 has been used up.

Figure 7:
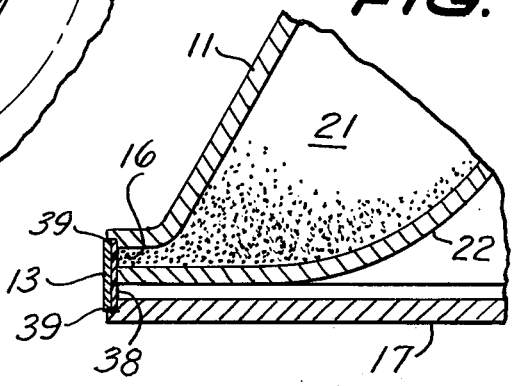
FIG. 7 is a cross-sectional view in detail of the lower left hand corner of FIG. 3, but illustrating an alternative arrangement for sealing the annular opening at the bottom of the storage compartment in the bell-shaped housing.

Referring now to FIG. 7, there is shown a possible variation in the sealing means for annular opening 16. In some applications, particularly where a long shelf life for the fire extinguisher is required after it has been filled with a dry fire extinguishing chemical, it is desirable to fully evacuate all air from storage chamber 21. In order to accomplish this, an extremely tight seal is necessary at annular opening 16. As shown in FIG. 7, gasket 38, which may be of rubber, neoprene or another similar resilient substance, is placed over annular opening 16 in mating relation with shoulders 39 provided in housing 11 and bottom plate 17. Band 13 is then placed over gasket 38 in the same manner as previously described.

Figure 12:
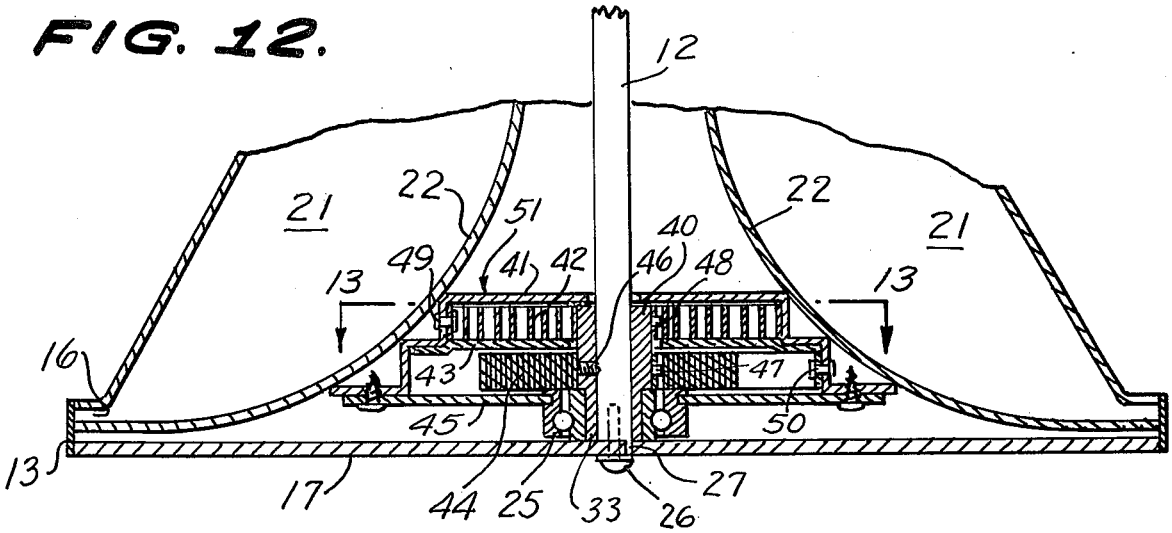
FIG. 12 is a broken away cross-section, similar to that in FIG. 3, but illustrating another embodiment of the invention.
Figure 13:
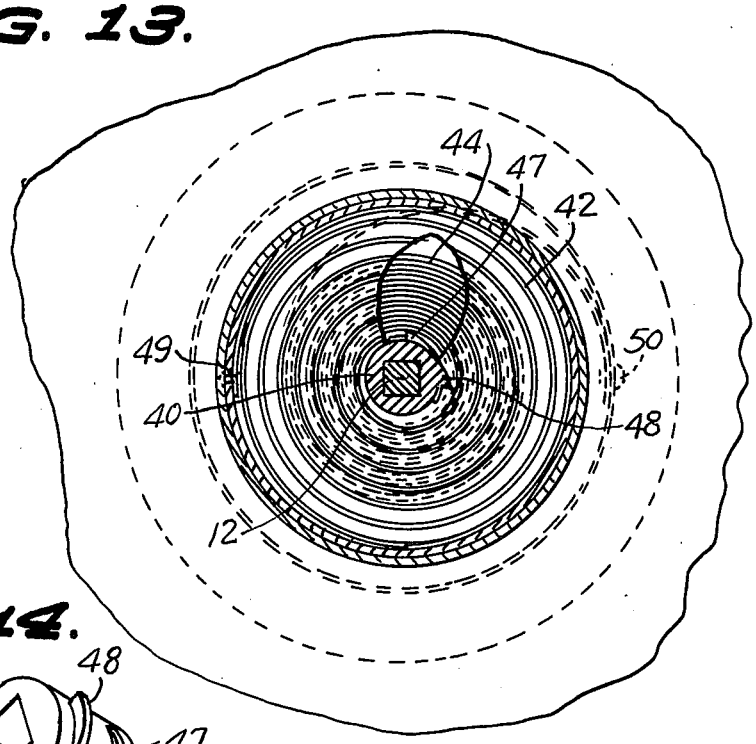
FIG. 13 is a cross-sectional view taken on line 13—13 in FIG. 12.
Figure 14:
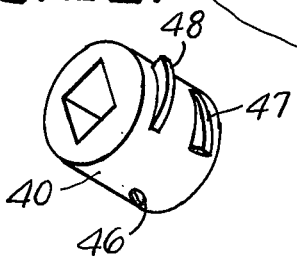
FIG. 14 is a detailed perspective view of the spring-engaging detent means used with the embodiment of FIG. 12.

Referring now to FIGS. 12 and 13, there is shown a modification in the spring winding means of the present invention. In this embodiment, spring cage 51 comprises a first compartment between upper plate 41 and center plate 43 within which is disposed spring 42, and a second compartment between center plate 43 and lower plate 45 within which is disposed spring 44. Springs 42 and 44 are wound in opposite directions by sprng-engaging fitting 40, which is fixedly secured to mounting shaft 12 by set screw 46. Fitting 40, as shown best in FIG. 14, is provided with oppositely facing detents 48, for engaging spring 42, and 47 for engaging spring 44. These detents operate in precisely the same manner as the single detent 31 described above in connection with FIGS. 3 through 6.

The end of spring 42 opposite to that engaged with detent 48 is fixedly secured to a side wall of the first compartment by rivet 49, while the end of spring 44 opposite to that engaged with detent 47 is similarly affixed to a side wall of the second compartment by rivet 50.

In the operation of the embodiment of FIGS. 12, 13 and 14, bell-shaped housing is first wound in a direction so as to tighten, for example, spring 42. This will not result in the winding of spring 44, since detent 47 faces the opposite way to detent 48. When band 13 releases, under the influence of abnormally high temperature conditions, as described above, the fire extinguishing assembly will first rotate in a direction, say clockwise, under the influence of wound spring 42. As the same time, spring 42 is unwinding, spring 44 will be winding due to the fact that detent 47 will now become engaged with the end of spring 44. This process will continue until both springs run down, thus providing increased coverage of the burning area due to the two directions of rotation of the extinguisher.

While these embodiments of the invention have been set forth with particular reference to the drawings, variations and modifications therein will be readily apparent to those skilled in the art and are to be considered within the scope of the present invention. For example, band 13 could be made of plastic, wax or the equivalent, metal, wood and paper, fabrics and cloth, synthetic fibers, clay or ceramic material, natural or synthetic rubber, leather, glass, a petroleum derivative, or any combination of the above. Band 13 itself could be used as the fusible link in addition to serving the sealing and clamping functions. This could be accomplished if the band were made of a material such as wax, plastic or soft lead, for example, which would melt when the heat reaches a preselected point, causing the band to melt and drop away, thus actuating the fire extinguisher.

A second, and in many ways preferred, group of embodiments of the invention involve the same principles as set forth with respect to the embodiments described in connection with FIGS. 1 through 14. The primary difference in the second group of embodiments is that a windable spring to provide the motive force is not needed. Rather, this force is provided by the expulsion of the fire extinguishing composition through jet-like nozzles under pressure. Further, in these embodiments, band 13 is not required, but rather fusible elements are provided which perform a sealing function with respect to the nozzle orifices, so that when the fusible elements part, the nozzles are opened and the fire extinguishing composition is expelled under high pressure. In all these embodiments, as in the embodiments described above, any suitable liquid, chemical or gaseous extinguishing composition may be utilized, the difference being that in this group of embodiments the composition must be stored under pressure.

The preferred fire extinguishing composition is Freon, FE1301, which creates its own pressure of about 200 psi at 70° F. However, it will be understood that in the embodiments of the invention described below, either Freon or some other liquid, chemical or gaseous extinguishing composition will be stored under pressure in the canister or storage unit of the extinguisher.

Figure 21:
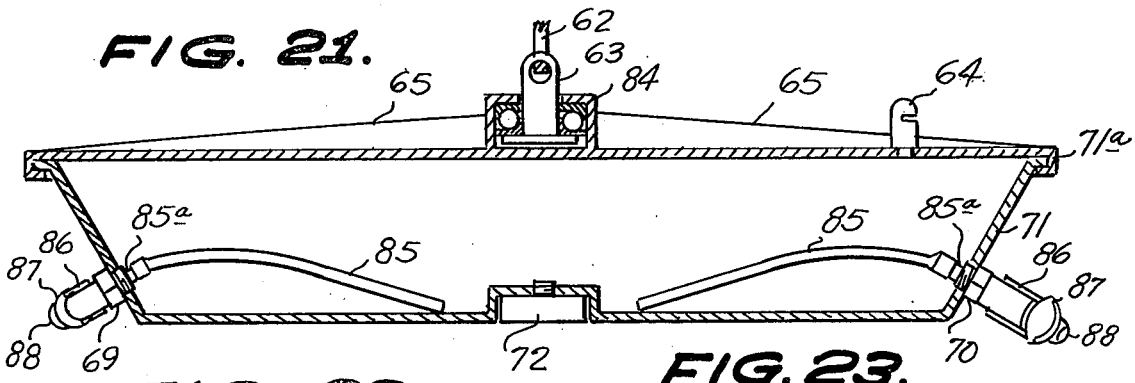
FIG. 21 is an enlarged sectional view taken on the line 21—21 in FIG. 16, looking in the direction of the arrows.
Figure 22:
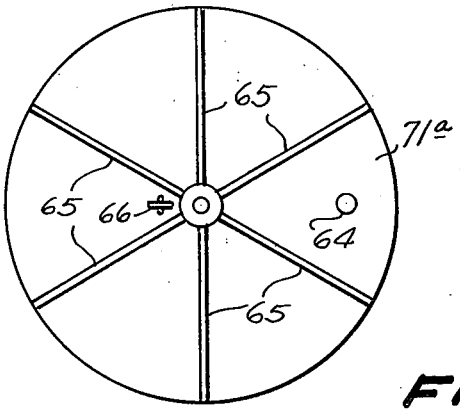
FIG. 22 is a top plan view of the fire extinguisher, without the automatic lowering and retracting apparatus, shown in FIG. 15.
Figure 23:
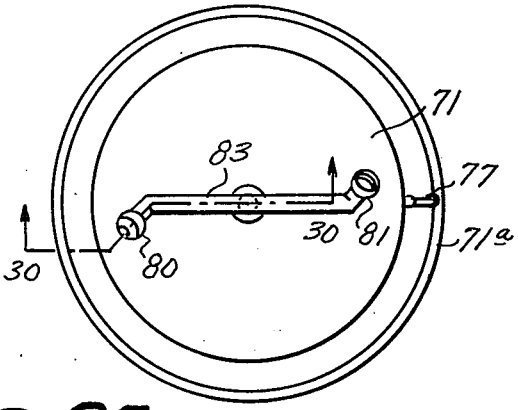
FIG. 23 is a bottom plan view of the apparatus shown in FIG. 19.

Referring now to FIGS. 15, 16, 17, 18, 21 and 22, there is shown one form of nozzle arrangement and automatic lowering and retraction apparatus. The canister 71, containing the fire extinguishing composition under pressure, is sealed by cover 71*a* which is crimped along the upper edge of canister 71, as shown in FIG. 21. Spray nozzles 67, 68, 69 and 70 are positioned equally around the lower periphery of canister 71 and are angled downwardly so that when the chemical composition is released through the nozzle orifices, the resultant reactive force will cause the canister to rotate by means which will be described more fully hereinafter. As shown generally in FIG. 21, each of the spray nozzles is sealed by a sealing means including fusible element 87 which retains in place spring clip 86. Tension adjusting screw 88 is provided in order to insure a tight seal. When the fusible element melts, in the presence of a predetermined temperature, spring clip 86 will be released and the sealing element will fall from its position in front of the nozzle orifice, permitting the extinguishing composition to be forcefully expelled under pressure and causing the canister 71 to rotate. It should be realized that the sealing element, fusible element and spring clip assembly may take any one of a number of forms, preferred embodiments of which will be more fully described hereinbelow.

Attached to the inner end of the spray nozzles are tubes 85 which are in communication with the fire extinguishing composition. However, tubes 85, as shown in FIG. 21, are optional, since the fire extinguishing composition would be forcibly expelled through the spray nozzles without the use of the tubes.

Mounted in the bottom center of canister 71 and in communication with the interior thereof is pressure gauge 72 for indicating the pressure within the canister. This gauge is necessary in order to indicate whether the pressure is at the desired point, for if it has substantially fallen, the extinguisher will be inoperative and it is imperative to be able to readily ascertain this fact. Disposed in the upper surface of cover 71*a* are pressure relief valve 64 and ball bearing assembly 84 for rotatably mounting canister 71 to shaft 63.

Attached to one end of shaft 63 is cord 62 which is wound around spool 73, rotatably mounted in bracket 61 and biased to the wound-up position shown in FIGS. 1 and 2 by spring 74 mounted in spring housing 74*a*. As shown in detail in FIG. 18, spring 74 is fixed at one end by conventional securing means 115 to shaft 75 and at the other end to the inner periphery of spring housing 74*a* which is integral with spool 73. Thus, when canister 71 is lowered and cord 62 is extended, as will appear more fully hereinbelow, spring 74 will become more tightly wound with a tendency to return to its original unwound position. The force of the spring will, therefore, be in a direction to cause spool 73 to wind cord 62 back to the original position shown in FIGS. 15 and 16, and to retract the extinguisher.

Normally retaining the canister 71 in the retracted position is fusible link 66 which connects mounting bracket 61 with canister top 71*a*. Fusible link 66 is made of a material which has a lower melting temperature than the fusible element sealing the spray nozzles. Therefore, when a fire starts, fusible link 66 will melt first, and canister 71 will descend, unrolling cord 62 from spool 73. When the canister is in the vicinity of the fire, the intense heat will melt the higher melting point fusible elements sealing the spray nozzles, causing the extinguishing composition to be forcibly expelled through the orifices in the nozzles and canister 71 to rotate around the shaft 63 on ball bearing assembly 84. When the canister has substantially expelled all its contents, it will be light enough in weight for the force of spring 74 to rewind cord 62 on spool 73, as explained above. The canister will then be retracted out of the way.

The entire assembly is mounted to ceiling 76 or other fixture by ball bearing or other pivotable mounting 60 so that when the canister rotates, as explained above, cord 62 will not become entangled. Rather, if there is any force transmitted to the cord, the entire assembly will rotate on fitting 60.

Figure 24:
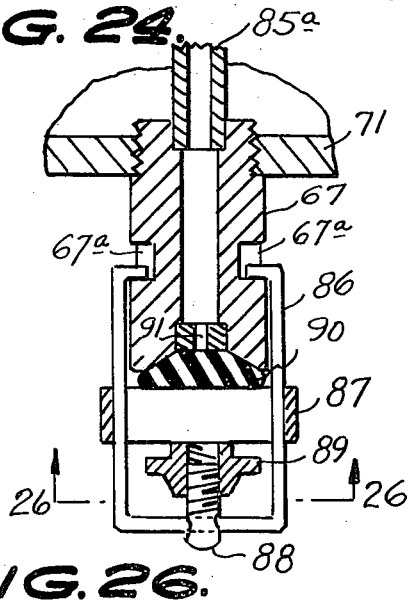
FIG. 24 is an enlarged cross-sectional detail of the spray nozzle, taken on the line 24—24 in FIG. 17, looking in the direction of the arrows.
Figure 25:
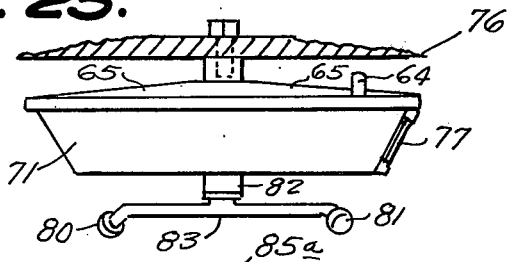
FIG. 25 is a front elevation of the fire extinguishing apparatus shown in FIG. 19, mounted without the automatic lowering and retracting apparatus.
Figure 26:
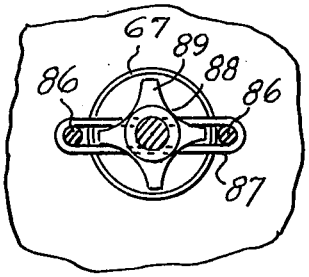
FIG. 26 is a cross-sectional view taken on the line 26—26 in FIG. 24, looking in the direction of the arrows.
Figure 27:
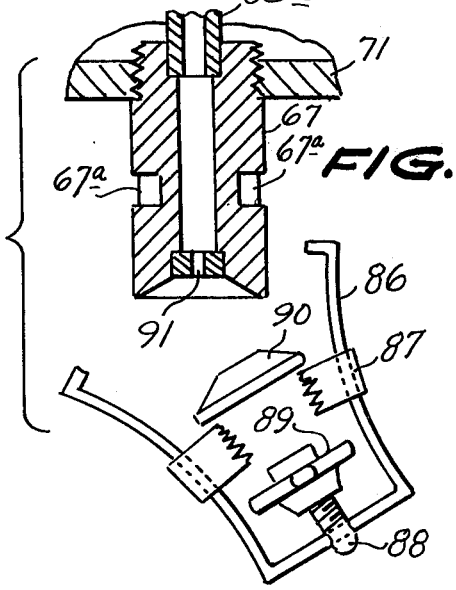
FIG. 27 is an exploded version of the same view shown in FIG. 24, after the fusible element has parted.
Figure 36:
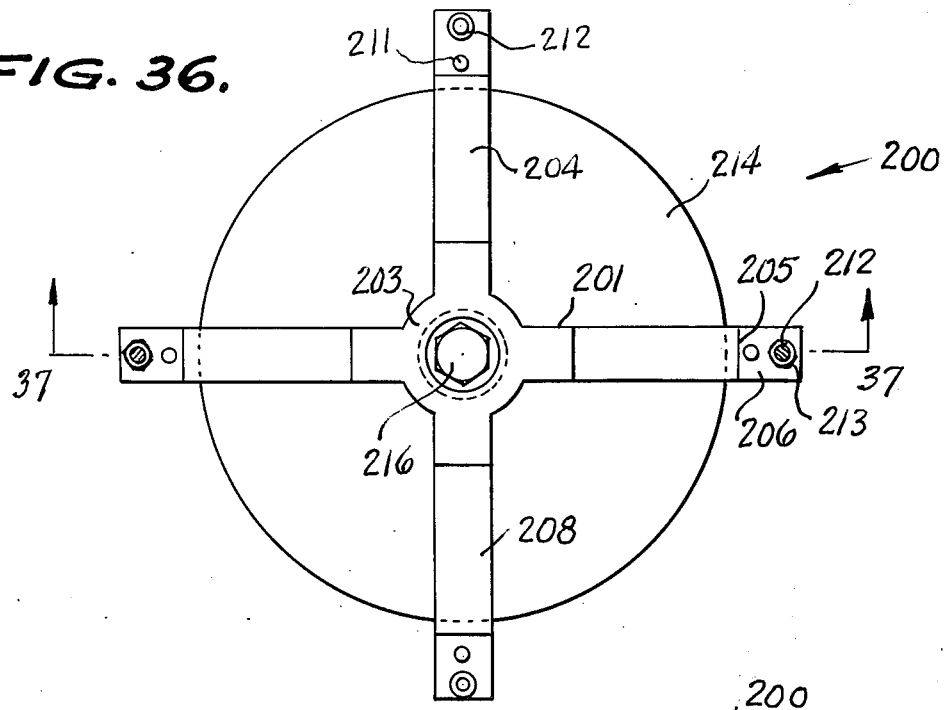
FIG. 36 is a top plan view of another alternative structure for a fire extinguisher according to the present invention.

Turning now to FIGS. 24 and 26, the details of the spray nozzle and fusible sealing assembly are shown. Disposed over orifice 91 of spray nozzle 67 is seal 90 which may be either of metal or plastic. Pressed against seal 90 by tension screw 88, having finger-held tightening means 89, is fusible member 87. Passing through member 87 and forced thereby into position in recesses 67*a* in nozzle 67 is spring clip 86. As shown in FIG. 27, when fusible member 87 parts due to the presence of a fire, spring 86 will release and the entire assembly, including seal 90, will fall away, leaving orifice 91 unobstructed. This will permit the fire extinguishing composition to be expelled from the spray nozzle 67, or in a similar manner from any of the other spray nozzles 68, 69 and 70. As shown in FIG. 24, spray nozzle 67, as well as the other spray nozzles 68, 69 and 70, is threadedly engaged with the wall of canister 71 so that communicating extension 85*a* is disposed within the fire extinguishing containing interior of the canister. Tube 85 may then, optionally, be placed over extension 85*a*.

Referring now to FIGS. 19 and 20, there is shown an alternative embodiment for the automatic lowering and retracting means for the canister 71. The canister itself is substantially identical to that described above in connection with FIGS. 15 and 16 except that it is fixedly mounted rather than being pivotally mounted. Instead, rotatable nozzle assembly 83 comprising spray nozzles 80 and 81 is rotatably suspended by ball bearing mounting 82. The details of this portion of the assembly will be described more fully in connection with FIG. 29 below. Also included in the showing in FIG. 19 is sight gauge 77 which provides an indication of the liquid level in canister 71 and which may optionally be included in any of the embodiments herein described.

The automatic lowering and retracting apparatus in the embodiment shown in FIGS. 19 and 20 comprises spherical housing 78 which is mounted to ceiling or other fixtures 76 by ball bearing mounting 60 as in the case of the embodiment of FIG. 15, described above. Disposed within spherical housing 78 is spring-wound shaft 79 about which is wound cord 62. As in the above-described embodiment, cord 62 is fastened to shaft 63*a* which in this case, as explained above, is fixedly secured to canister 71. The lowering and retracting operation of this embodiment is precisely the same as that described above, after fusible link 66 parts in the presence of a temperature condition signifying the onset of a fire.

Reference is now made to FIGS. 23, 25, 30 and 31 for the detailed construction of the rotating nozzle unit embodiment of the present invention. Canister 71 is fixedly mounted to ceiling or other fixture 76 by any conventional means and in the interest of simplicity, in this explanation, the automatic lowering and retracting means has been omitted. Rotatably mounted on double ball bearing mounting 82 is nozzle assembly 83 having oppositely and downward angularly faced nozzles 80 and 81. Passageway 116 communicates the fire extinguishing composition disposed in the interior of canister 71 with the nozzle assembly. As shown, the nozzles 80 and 81 may, for example, be threadably engaged with the nozzle assembly 83. For purposes of illustration, a different fusible sealing assembly is shown in FIGS. 30 and 31. However, it should be realized that any of the other fusible sealing assemblies illustrated herein may be equally well used. Tension screw 96 is adjusted so as to force fusible element 97 against seal 98 over orifice 91 of spray nozzle 80. The operation of this assembly is precisely the same as that described above in connection with FIGS. 24, 26 and 27, with only the shapes of the various components, as illustrated, being different.

Another possible arrangement of spring clip 92, fusible element 93 and seal 94 are illustrated in FIGS. 28 and 29. However, again, the operation of this fusible sealing assembly is precisely the same as that in FIGS. 24, 26 and 27, with only the shapes of the components being different.

Turning now to FIGS. 32, 33, 34 and 35, there is illustrated a simplified version of the rotating canister type extinguisher, shown in FIGS. 15 and 16. In this embodiment, for purposes of illustration, the automatic lowering and retracting apparatus is not shown, but of course it should be realized that such apparatus may be used with any of the extinguishers illustrated in this application. Canister 99 is substantially football shaped and comprises upper half 100 and lower half 101 which may be joined as by welding. Fill cap 106 is provided for filling the interior of canister 99 with the desired fire extinguishing composition and relief valve 107 is provided as in the other embodiments. Shaft 104 is journaled within double ball bearing mounting 105 and is secured at its ends by fittings 109 and set screws 108, for example. Nozzles 102 and 103 are provided which are oppositely faced and angled downwardly as in the case of the previously described nozzles. The entire assembly is fixed to the ceiling or other fixture by conventional L-bracket 100, or other similar mounting.

Turning now to FIG. 35, there is illustrated in detail an alternative fusible sealing assembly. In this instance, screw cap 112 is itself the fusible element which presses sealing ball 111 against the opening to passageway 113 of spray nozzle 102. In operation, when fusible screw cap 112 melts, sealing ball 111 will fall away from passageway 113 and the fire extinguishing composition will be forcibly ejected through spray nozzles 102 and 103, causing the entire assembly to rotate about shaft 104.

Figure 37:
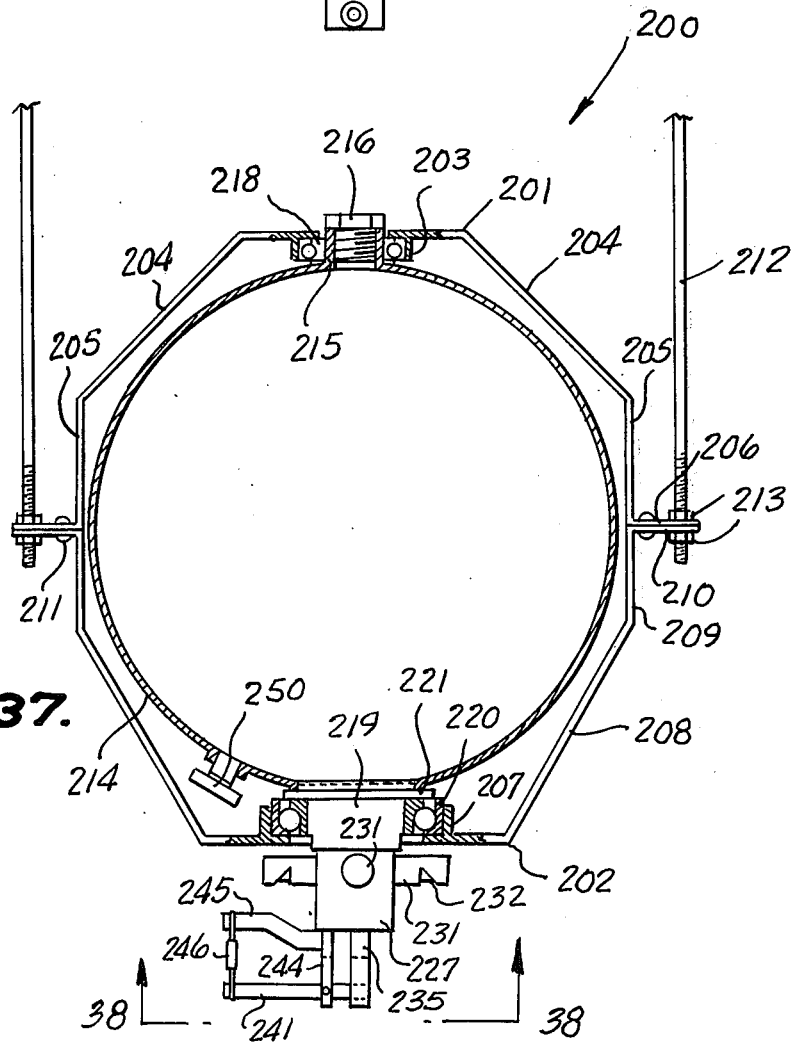
FIG. 37 is a vertical cross-sectional view taken substantially on the line 37—37 of FIG. 36.

Referring now to FIGS. 36, 37, 38 and 39, a further embodiment of the present invention is shown, designated generally at 200. The fire extinguisher 200 comprises a frame structure in the form of a cage defined by a top bracket assembly 201 which faces downwardly and a bottom bracket assembly 202 which faces upwardly. The top bracket assembly 201 comprises a downwardly facing bearing-receiving seat 203 to which are rigidly connected four evenly spaced outwardly and downwardly bent cage bars 204 having vertical outer end portions 205 provided with outwardly extending bottom end flanges 206. The bottom cage bracket assembly 202 similarly comprises a central upwardly facing bearing-receiving seat member 207 to which are rigidly connected four equally spaced upwardly and outwardly inclined cage bars 208 having vertical end portions 209 provided with right angle flanges 210 which abut and are rigidly secured to the aforementioned flanges 206 by means of rivets 211. The superimposed flanges 206 and 210 are suitably apertured to receive the ends of suspension rods 212 which are secured to the flanges by means of opposed pairs of lock nuts 213, as shown in FIG. 37, whereby the frame structure 201 and its contents can be suitably suspended from a ceiling.

Designated at 214 is a housing means for storing a fire extinguishing composition similar to that above described in connection with the previous embodiments disclosed herein, such as a composition similar to that employed in the embodiment of FIGS. 32, 33, 34 and 35. The housing means 214 is in the form of a spherical canister formed with a top neck portion 215 which threadedly receives a closure screw plug 216, as shown in FIG. 37. The neck portion 215 extends axially through the central bearing seat 203, and a conventional ball bearing assembly 218 is provided between neck portion 215 and the depending cylindrical wall of the bearing-receiving seat 203.

The spherical canister 214 is provided at its bottom portion in axial alignment with the neck portion 215 with a depending internally threaded conduit fitting member 219 which extends through and is rotatably supported within the seat portion 207 by a conventional ball bearing assembly 220, as shown in FIG. 39. As shown in FIG. 39, a spacer washer 221 is provided between the inner race 222 of bearing assembly 220 and the adjacent portion of canister 214. The outer race 223 of the bearing assembly 220 is seated in the bearing seat-receiving structure 207.

As shown in FIG. 39, the conduit fitting 219 is in communication with the interior of the canister 214 and is formed with an inwardly extending flange 224. A frangible sealing disc 225 of suitable thin yieldable frangible material, such as soft sheet metal, or the like, is sealingly clamped against the annular bottom of flange 224 by a clamping ring 226 threadedly engaged in the fitting 219. A depending chamber 227 is threadedly engaged in the fitting 219 and clampingly engages the outwardly projecting top flange 228 of a guide sleeve 229 provided in the top end portion of the chamber 227, clamping the flange 228 sealingly against the ring 226. The chamber 227 is axially aligned with the respective central vertical top and bottom bearing assemblies 218 and 220, as will be apparent from FIG. 39.

As will be seen from FIG. 39, the canister 214 is rigidly connected to the chamber 227 and is journaled in the cage-like frame structure 201 for axial rotation by means of the bearing assemblies 218 and 220. Four equally spaced radially extending conduit tubes 231 are threadedly secured in the cylindrical wall of the chamber 227 and are formed at their outer ends with downwardly and laterally inclined impulse jet nozzles 232 which are oriented similarly to the previously described nozzles, such as nozzles 80, 81 of FIG. 19. Thus, when the pressurized material in canister 214 is released and is allowed to flow through the chamber 227 and the tubes 231 and discharged from the impulse jet nozzles 232, the jet reactions cause the canister, conduit 227 and tubes 231 to rotate and distribute the material from the canister to the subjacent area in the manner previously described in connection with the other embodiments of the present invention.

The conduit member 227 is provided with a bottom wall 233 having a central aperture 234, and slidably engaged through said aperture is a shaft member 235 having a pair of outwardly projecting lugs 236 at its upper portion. A coil spring 237 surrounds the shaft member 235 and bears between the bottom wall 233 and lugs 236, biasing the shaft member upwardly. The top end of the shaft member is integrally formed with a piercing element comprising a generally cylindrical body 238 formed with an inclined sharpened top rim portion 239 which is sufficiently sharp to penetrate and rupture the frangible disc 225 when spring 237 is released to push the shaft 235 upwardly from the normal position thereof shown in FIG. 39.

The lower end portion of shaft 235 projects below the bottom wall 233 and is formed with a slot 240. A lever member 241 is pivoted at 242 in the lower end portion of a slot 243 formed in a vertical arm 244 threadedly engaged in a peripheral portion of the bottom wall 233. A laterally extending rigid arm 245 is rigidly secured to the upper portion of the depending arm 244, as shown in FIG. 39. A fusible link 246 connects the outer end portions of rigid arm 245 and lever member 241, the opposite end portion of the lever member being engaged in the slot 240 and acting on the lower end portion of the slot, as shown in FIG. 39, to hold the shaft 235 in its lowered normal position wherein the piercing element 239 is located immediately below the frangible disc 225.

In operation, when the ambient temperature adjacent the fire extinguisher 200 rises to an abnormal value, such as in the case of a fire, the fusible element 246 melts and releases the lever member 241. This allows the spring 237 to expand and push the shaft member 235 upwardly, the force of the spring being sufficient to cause the piercing element 239 to engage and rupture the frangible disc 225. This releases the fire extinguishing material of canister 214 and allows this material to pass downwardly through the chamber 227 to the jet tubes 231, the jets discharging from the nozzles 232 causing the assembly including the canister 214 to rotate in the manner above described, and causing the material to be distributed to the intended area in a manner similar to that described in connection with the previously disclosed embodiments of the present invention.

The disc 225 is of sufficiently yieldable character to be ruptured by the expansive force of the contents of the canister 214, or to be distorted by the pressure developed in the canister so as to become unsealed, responsive to an abnormal external temperature condition, so that in the event of failure of the fusible element 246 to melt, the abnormal temperature condition will still cause the sealing disc 225 to be ruptured or distorted sufficiently to release the contents of the canister 214 and allow said contents to pass downwardly through the chamber 227 and thence outwardly through tubes 231 and jet nozzles 232. Thus, another safety factor is provided to insure the activation of the fire extinguisher in the event of a fire in the area to be protected.

A pressure gauge 250 is provided in the lower wall portion of the canister 214, said gauge being readily visible from below the fire extinguisher assembly to indicate the pressure within the canister and thus indicate the readiness of the apparatus to operate in the case of fire. The contents of the canister 214 may be easily replenished, as required, through the top neck portion 215 by removing the screw plug 216, thereby allowing access to the interior of the canister for such replenishment.

Figure 40:
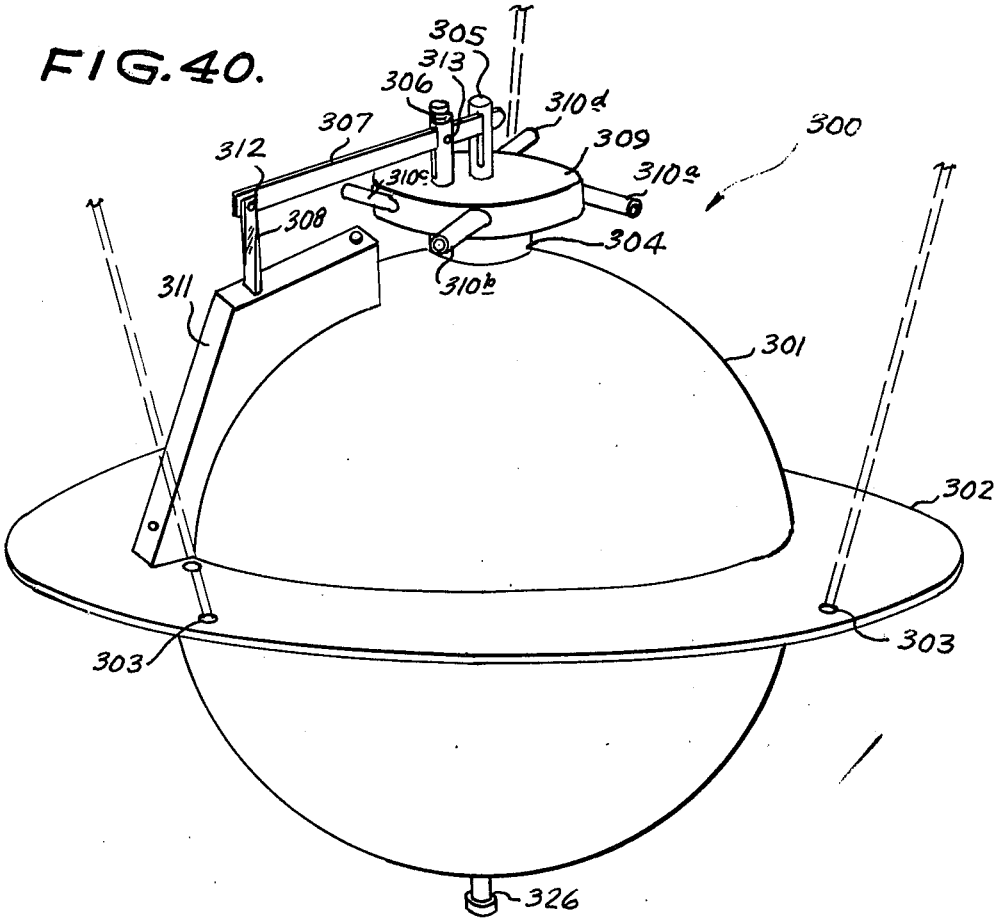
FIG. 40 is a perspective view of a further embodiment of the present invention wherein electronic actuating means may be employed.
Figure 41:
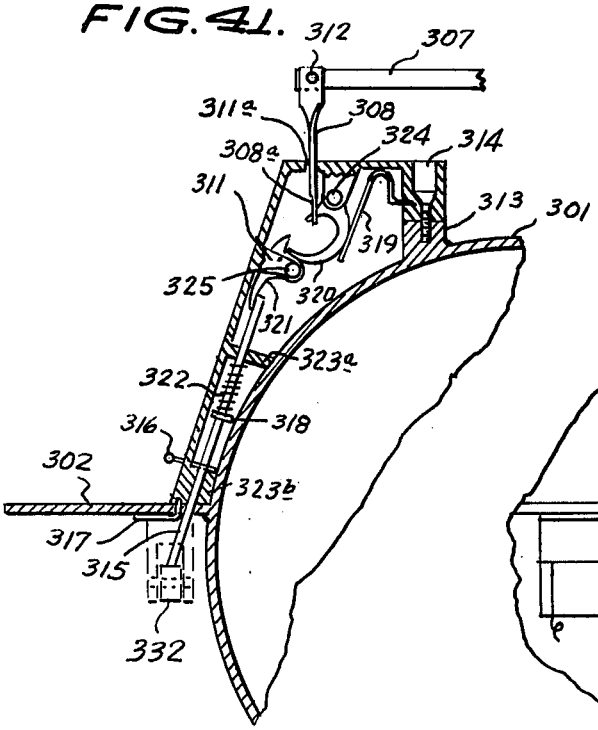
FIG. 41 is an enlarged cross-sectional detail of the trigger mechanism of the embodiment shown in FIG. 40.
Figure 42:
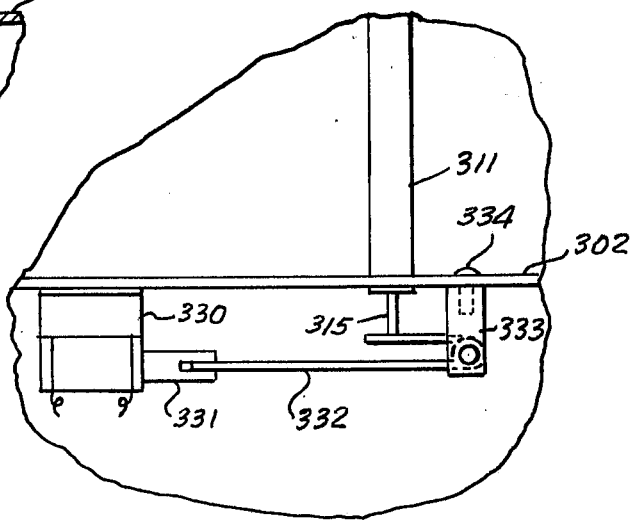
FIG. 42 is an enlarged detail of a portion of the electronic actuating means and trigger mechanism for the embodiment shown in FIG. 40.

Referring now to FIGS. 40, 41 and 42, there is shown a further embodiment of the present invention, designated generally at 300. The fire extinguisher 300 is somewhat similar to the embodiment described above in connection with FIGS. 36, 37, 38 and 39, in that it includes a generally spherical housing 301 for storing the fire extinguishing composition. The housing 301 is provided with a mounting ring 302 having mounting holes 303 which may be disposed about the periphery of ring 302 at intervals of 120°. In mounting fire extinguisher 300, cables or other suitable mounting means will be inserted through mounting holes 303 and the assembly will be suspended from the ceiling or any other suitable location. It should be noted that for convenience of illustration, fire extinguisher 300 in FIG. 40 is shown inverted from the position in which it would normally be suspended.

Mounted on the underside of housing 301 is ball bearing assembly 304 for mounting nozzle assembly 309 having nozzles 310*a*, 310*b*, 310*c* and 310*d* to housing 301. Passing through nozzle assembly 309 and ball bearing assembly 304 is plunger shaft 305 for rupturing a frangible disc disposed between the lower surface of housing 301 and nozzle assembly 309. The details of the frangible disc, the plunger shaft 305 and the ball bearing assembly 304 are not illustrated in detail in connection with this embodiment of the invention, since in all essential respects they are identical to the corresponding elements illustrated in detail in connection with the embodiment of the invention illustrated in FIGS. 36, 37, 38 and 39.

Disposed on the lower side portion of housing 301 is trigger mechanism housing 311 within which the trigger mechanism is disposed as will appear more fully hereinbelow. Passing through slot 311*a* in trigger mechanism housing 311 (see FIG. 41) is fusible link or connector bar 30, pivotally mounted to lever arm 307 by pin 312. Lever arm 307 in turn passes through slotted mounting arm 306 which is fixedly secured to the underside of nozzle assembly 309 and is pivotably secured thereto by pin 313. Lever arm 307 thus urges plunger shaft 305 in an upward direction as viewed in FIG. 41 and away from the frangible disc (not shown).

Referring now to FIG. 41, it can be seen that mounting block 313 is fixedly secured to the surface of housing 301 and trigger mechanism housing 311 is secured thereto by mounting screw 314. Bracket 317 is also provided to hold the trigger mechanism housing in place. Disposed within trigger mechanism housing 311 is the trigger mechanism of this embodiment of the invention which, as will appear more fully below, under certain actuating conditions, will release fusible link or connector bar 308 with a predetermined amount of force and thus permit plunger shaft 305 to rupture the frangible disc (not shown) and cause the release of the fire extinguisher composition from housing 301 and into nozzle assembly 309. As described in connection with the previous embodiments, the introduction of the pressurized fire extinguishing composition into nozzle assembly 309 will cause the composition to be forcibly expelled through nozzles 310*a*, 310*b*, 310*c* and 310*d* and the resulting reaction will cause the entire nozzle assembly to rotate on ball bearing assembly 304 and thus spread the fire extinguishing composition over the desired area.

As shown in FIG. 41, fusible link or connector bar 308 is retained in its non-actuated position by trigger worm 320 which passes through slot 308*a* and is pivotably mounted to the upper inside surface of trigger mechanism housing 311 by pin 324. Flat spring 319 is provided to retain trigger worm 320 in its proper position during assembly. Pivotably mounted to the inner side surface of trigger mechanism housing 311 by pin 325 is trigger dog 321 which abuts against the end of trigger worm 320 and is retained in this position by spring loaded rod 315. As can be seen, rod 315 is retained in the position shown by the compression of spring 322 between guide arm 323*a* and projection 318 on rod 315. The lower arm of rod 315 passes through guide arm 323*b* and projects beyond the surface of mounting ring 302. Safety pin 316 is provided to retain rod 315 in position before the extinguisher is ready for use. Thus, when safety pin 316 is removed, spring 322 tends to force rod 315 in a downward direction as viewed in FIG. 41 (actually an upward direction). When rod 315 moves downwardly, it becomes disengaged from trigger dog 321, which in turn releases trigger worm 320, freeing fusible link or connector bar 308. This will cause lever arm 307 to pivot about mounting arm 306 and permit plunger shaft 305 to pierce the frangible disc (not shown) with the force provided by an internal spring such as spring 237 illustrated in connection with the embodiment shown in FIG. 39.

Referring now to FIG. 42, rod 315 is retained in place by trigger lever arm 332, when the fire extinguisher is installed for operation. Trigger lever arm 332 is pivotally mounted to mounting block 333 which in turn is secured to the upper surface of mounting ring 302 by mounting screw 334. Also secured to the upper surface of mounting ring 302 is solenoid 330 having solenoid plunger 331 which is linked to trigger lever arm 332 such that when the solenoid is actuated, plunger 331 will move downwardly and release rod 315, when the extinguisher has been placed in operative condition by the removal of safety pin 316. As described above, the release of rod 315 will actuate plunger shaft 305 through the action of the trigger mechanism.

It will be understood that plunger shaft 305 may be actuated in this embodiment of the invention by either of two basic methods. First, if an incendiary condition exists locally in the vicinity of the fire extinguisher 300, element 308 which is formed of a fusible material as in the other embodiments described hereinabove, will operate as a fusible link and part in the presence of a predetermined temperature. The other method is through actuation of a solenoid 330, which as described above causes trigger lever arm 332 to disengage from rod 315 which in turn actuates the trigger mechanism, freeing element 308, in this instance operating as a connector bar.

In certain applications of this embodiment of the invention, it may be desirable to employ a plurality of fire extinguisher units 300, each associated with its own actuating solenoid 330. Through the provision of suitable control circuitry, each extinguisher may be separately actuated in response to the conditions existing in the location where it is disposed, or alternatively, all extinguishers may be simultaneously actuated by manually closing a main switch which simultaneously applies activating current to each of the associated solenoids 330. One such possible arrangement will now be described with reference to FIGS. 43 and 44.

Figure 43:
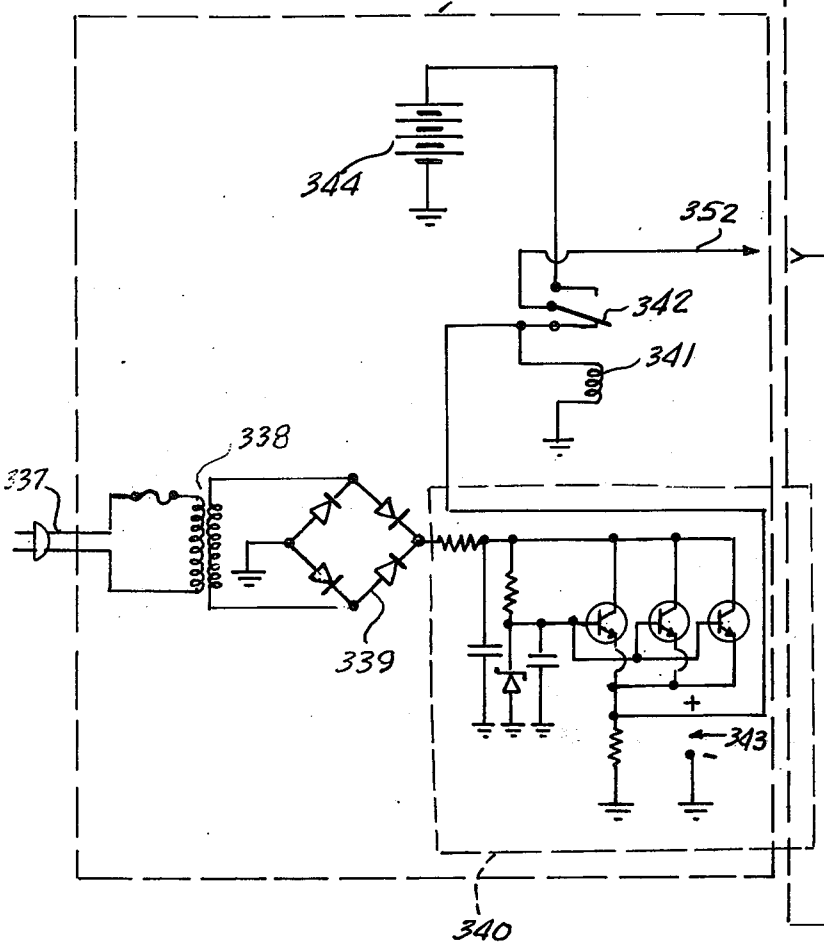
FIG. 43 is a schematic wiring diagram of the power supply portion of the electronic actuating apparatus for the FIG. 40 embodiment.

Set forth in FIG. 43 is the power supply section generally designated 335 for the solenoid actuating circuitry and which may be conveniently housed in a centrally located control panel. The conventional 125-volt A.C. input 337 is fed through transformer 338 to full-wave rectifier 339 and thence to conventional voltage regulation section 340 which produces a regulated 24-volt D.C. output at terminals 343. When A.C. power source 337 is operative, current flow through the winding of relay 341 and contact arm 342 is in the lower contact position as shown. If for any reason, there is a failure of power source 337, contact arm 342 will move to the upper contact position and switch alternate D.C. power supply 344 into circuit with the switching section 336 set forth in FIG. 44.

Figure 44:
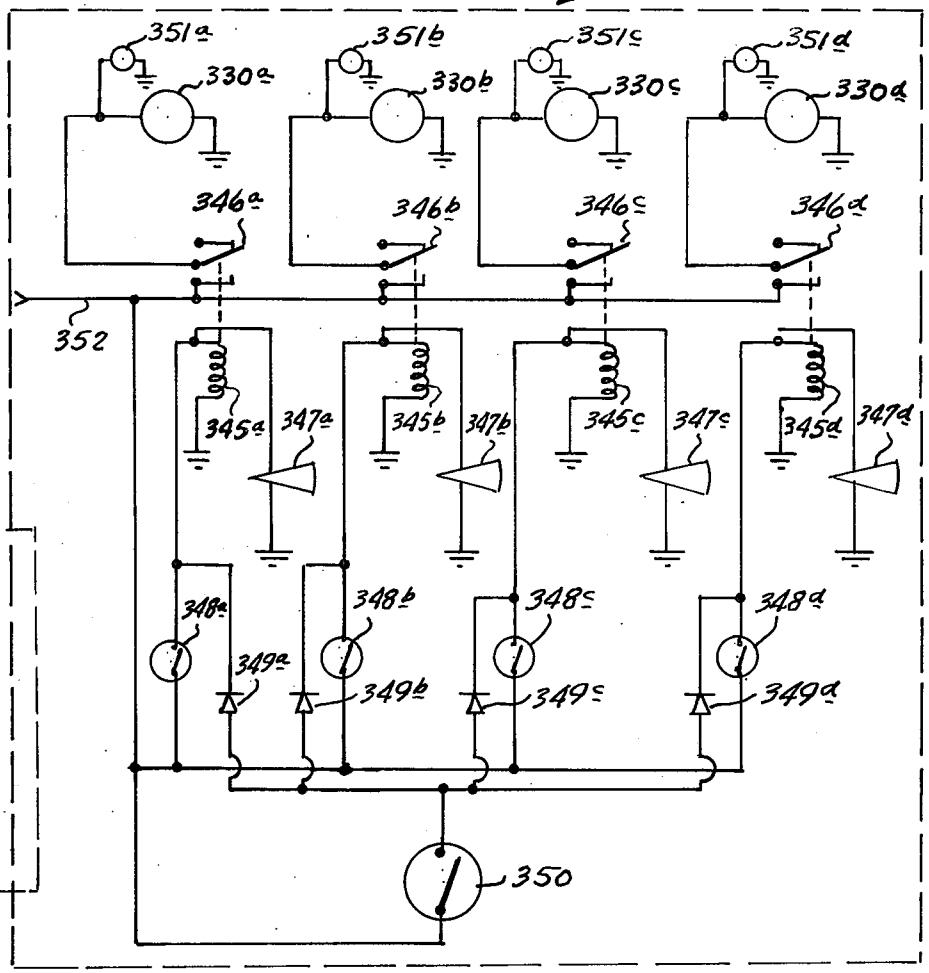
FIG. 44 is a schematic wiring diagram of the control portion of the electronic actuating apparatus for the FIG. 40 embodiment.

Turning now to FIG. 44, there is shown the switching section 336 for a typical array of four separate fire extinguishers according to the instant embodiment of the invention having associated therewith solenoids 330*a*, 330*b*, 330*c* and 330*d*, respectively. Connected in parallel with each of solenoids 330*a* through 330*d* are indicating lights 351*a* through 351*d*, respectively. Thus, when any of the solenoids is actuated in a manner to be described hereinbelow, its associated indicating light will be on, showing that the fire extinguisher has been actuated. For convenience, the indicating lights may be centrally located at the control panel.

Connected to the power supply section 335 via lead 352 are normally open detectors 348*a*, 348*b*, 348*c* and 348*d* which may be of any conventional type such as smoke detectors, thermal detectors or ionization detectors and which close in the presence of the fire related condition which the detector is designed to sense. Connected in series with each of detectors 348*a* through 348*d* are the windings of time delay relays 345*a* through 345*d*, respectively. Thus, when any of the detectors 348*a* through 348*d* closes in response to the detected condition, current will flow through the winding of its associated time delay relay 345*a* through 345*d*. Also connected in series with each of detectors 348*a* through 348*d* are conventional electrically actuated alarm means, such as sirens for example, 347*a* through 347*d*, respectively. When current flows through any of windings 345*a* through 345*d*, the associated contact arm 346*a* through 346*d* will move from the position shown in FIG. 44 to the lower contact position, thus placing its associated solenoid 330*a* through 330*d* in circuit with the power supply via lead 352. The respective solenoid will then actuate its associated fire extinguisher in a manner described hereinabove with respect to FIGS. 40, 41 and 42. The time delay for relays 345 is chosen to permit any personnel in the area where one of the alarms 347 sounds, to clear the area before the fire extinguishing composition commences to be dispersed in that area.

Relay windings 345*a* through 345*d* are also connected to power supply section 335 via lead 352 through main switch 350 and isolating diodes 349*a* through 349*d*, respectively. Main switch 350 which may normally be located at the control panel, may be closed when an incendiary condition is observed which requires the actuation of all extinguishers simultaneously. As can be seen, when main switch 350 is closed, current will flow through all the windings 345*a* through 345*d* and each of the associated solenoids will be actuated.

In operation, each fire extinguisher 300 is filled through filling port 326 and disposed in a preselected area. Solenoids 330*a* through 330*d*, or any other larger or smaller number, depending on the number of fire extinguishers employed, may then be wired, as plug-in modules or through other conventional wiring, into associated circuitry as illustrated in FIGS. 43 and 44 and into the central control panel which may be disposed in any convenient location in an industrial plant or other commercial establishment, for example. Safety pins 316 are then removed and the extinguishers are in readiness for operation. As pointed out hereinabove, the extinguishers may be operated in each of three different ways. First, any of fusible links 308 may part in response to a localized high temperature condition. Second, a solenoid 330 may be actuated by a localized detector 348 sensing a particular incendiary condition. Lastly, all extinguishers may be simultaneously actuated by closing main switch 350 at the central control panel. In connection with the actuation of the extinguishers by means of the solenoids, it is to be noted that one advantage of the trigger mechanism is the reduction in force required from the solenoid. By properly choosing the components such as spring 332, the 80 pounds of force normally needed by plunger shaft 305 to pierce the frangible disc, can be reduced to as little as 2 ounces required from solenoid plunger 331. This has the advantage of permitting the use of smaller solenoids and thus effecting substantial savings in electrical power.

In the above-described second and third group of embodiments, either a rotating canister propelled by the reaction force of the ejected pressurized fire extinguishing composition or a rotating nozzle assembly provides 360° coverage of the burning area. It should be realized that any of these extinguishers may be used either with or without the automatic lowering and retracting apparatus described and similarly any of the fusible sealing assemblies may be used with any of the second group of embodiments.

Other variations in the present invention will be apparent to those skilled in the art, and it is, therefore, intended that the scope of the invention be limited only by the claims set forth hereinbelow.

What is claimed is:

1. A fire extinguisher comprising:

a. hollow housing means for storing a fire extinguishing composition;

b. rotatable means in communication with the interior of said housing means for dispersing said composition in response to a predetermined condition;

c. frangible sealing means disposed between said housing means and said rotatable means;
d. means for rupturing said frangible sealing means in response to said predetermined condition;
e. link means formed of a fusible material normally preventing said rupturing means from rupturing said frangible sealing means;
f. trigger means removably engaged with said link means and normally retaining said link means in said rupture preventing condition; and
g. means for actuating said trigger means in response to said predetermined conditon, to cause said trigger means to become disengaged from said link means, so that said rupturing means will be released upon the melting of said link means in response to a localized temperature condition or upon the actuation of said trigger means.

2. The fire extinguisher set forth in claim 1 wherein said means for actuating said trigger means includes solenoid means.

3. The fire extinguisher set forth in claim 2 further including means for actuating said solenoid means in response to a detected condition indicative of a fire.

4. The fire extinguisher set forth in claim 3 wherein said means for actuating said solenoid means includes time delay means for delaying the actuation of said solenoid for a predetermined period of time following the detection of said condition.

5. The fire extinguisher set forth in claim 4 further including manually operated switching means for actuating said solenoid independently of said detected condition.

6. The fire extinguisher set forth in claim 5 wherein a plurality of solenoids are provided each associated with a separate fire extinguisher and said manually operated switching means is adapted to simultaneously actuate all said solenoids.

7. The fire extinguisher set forth in claim 4 further including audible alarm means actuated upon the occurrence of said detected condition.

8. The fire extinguisher set forth in claim 2 wherein said trigger means includes spring loaded means normally acting to retain said link in said rupture preventing condition and said solenoid means includes means linked to said spring loaded means for releasing said spring loaded means and causing said trigger means to become disengaged from said link means upon the occurrence of said predetermined condition.

9. A fire extinguisher comprising:
a. hollow housing means for storing a fire extinguishing composition under pressure;
b. nozzle means rotatably mounted on the underside of said housing means and in communication with the interior of said housing means;
c. frangible sealing means disposed between said nozzle means and the interior of said housing means;
d. spring loaded piercing means passing through said nozzle means and normally urged toward said sealing means for rupturing said sealing means;
e. a lever arm connected to said piercing means;
f. link means formed of a fusible material connected to the end of said lever arm remote from said piercing means;
g. trigger means engaged with said link means for causing said lever arm to urge said piercing means away from said sealing means; and
h. means for causing said trigger means to become disengaged from said link means in response to a predetermined incendiary condition, so that said piercing means will be allowed to rupture said sealing means either upon the parting of said link or upon the trigger means becoming disengaged from said link.

* * * * *